US005857378A

United States Patent [19]

Seeber et al.

[11] Patent Number: 5,857,378

[45] Date of Patent: Jan. 12, 1999

[54] METHOD OF CONTROLLING THE STROKE FREQUENCY OF A FORGING MACHINE AND FORGING MACHINE FOR CARRYING OUT THE METHOD

[75] Inventors: Alfred Seeber, Garsten/Steyr; Rupert Wieser, Seitenstetten, both of Austria

[73] Assignee: GFM Holding Aktiengesellschaft, Steyr, Austria

[21] Appl. No.: 931,640

[22] Filed: Sep. 16, 1997

[30] Foreign Application Priority Data

Sep. 17, 1996 [AT] Austria ..... 1640/96

[51] Int. Cl.[6] ..... B21J 7/46

[52] U.S. Cl. ..... 72/441; 72/402; 72/446; 72/452.5; 100/257

[58] Field of Search ..... 72/402, 452.5, 72/453.03, 453.04, 446, 441; 100/257

[56] References Cited

U.S. PATENT DOCUMENTS

| | | | |
|---|---|---|---|
| 3,783,672 | 1/1974 | Morgolenko et al. | 72/453.03 |
| 4,148,209 | 4/1979 | Bessho | 72/444 |
| 5,582,059 | 12/1996 | Schubert | 72/402 |
| 5,669,128 | 9/1997 | Futamura et al. | 72/453.03 |

FOREIGN PATENT DOCUMENTS

| | | | |
|---|---|---|---|
| 1812169 | 6/1970 | Germany | 72/402 |
| 479554 | 8/1975 | U.S.S.R. | 72/402 |

*Primary Examiner*—David B. Jones
*Attorney, Agent, or Firm*—Collard & Roe, P.C.

[57] ABSTRACT

For controlling the stroke frequency of a forging machine (1), which comprises a mechanical stroke drive (3) for the stroke movement of the forging punch (2) and a hydraulic drive connection (4) between stroke drive (3) and forging punch (2), the rotational speed of the stroke drive (3) is adjusted to a high stroke frequency of the forging punch (2), and for reducing the stroke frequency the hydraulic pressure of the drive connection (4) is decreased for periodically succeeding drive strokes in accordance with the drive-related increase with constant rotational speed of the drive (3), while at the same time the forging punch (2) is preferably blocked in the vicinity of the upper dead center. For this purpose, the drive connection (4) is connected to an accumulator (20) via a control valve (23) to be actuated in dependence on the stroke movement.

6 Claims, 1 Drawing Sheet

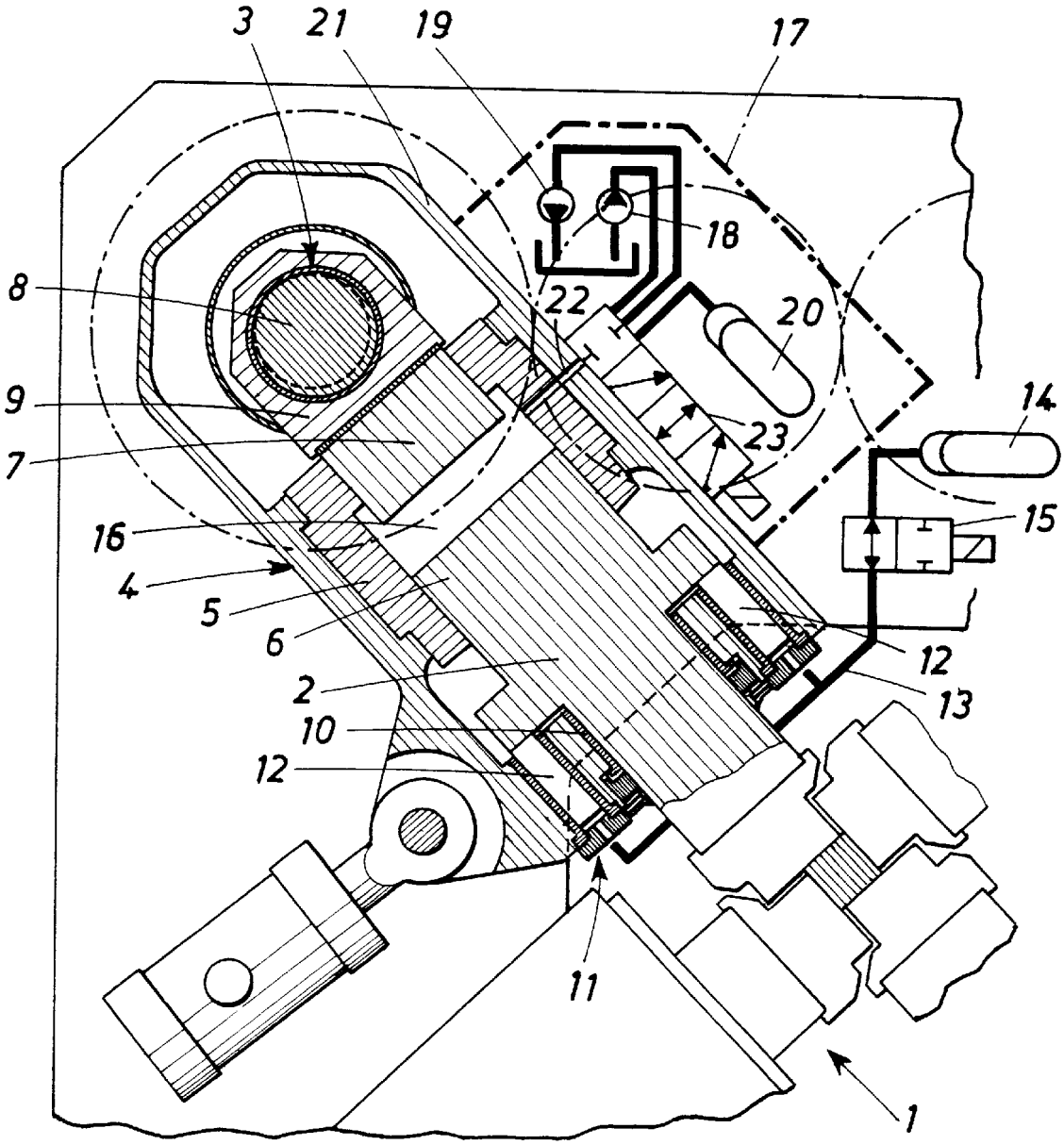
3
21
19
17
18
8
22
20
9
14
23
7
15
16
4
5
6
12
2
13
10
12
11
1

METHOD OF CONTROLLING THE STROKE FREQUENCY OF A FORGING MACHINE AND FORGING MACHINE FOR CARRYING OUT THE METHOD

BACKGROUND OF THE INVENTION

1. Field of the Invention

This invention relates to a method of controlling the stroke frequency of a forging machine with a mechanical stroke drive for the stroke movement of a forging punch and a hydraulic drive connection between stroke drive and forging punch, and to a forging machine for carrying out this method.

2. Description of the Prior Art

Such forging machines are available in various designs, where a crank or eccentric drive is used as stroke drive, whose stroke movement is transferred to the forging punch via a hydraulic drive connection, for which purpose the stroke drive actuates for instance a piston pump, whose pump space is hydraulically connected with a working cylinder associated to the forging punch. These forging machines provide for an easy overload protection and an adjustment of the stroke position with a high forging efficiency by changing the hydraulic volume in the hydraulic drive connection. So far, however, the stroke numbers of the forging punches can merely be controlled via the mechanical drive, which due to the losses of kinetic energy occuring during a reduction of the rotational speed only provides for a rather restricted range of control.

SUMMARY OF THE INVENTION

It is therefore the object underlying the invention to provide a method as described above, by means of which the stroke frequency of the forging hammers can be influenced efficiently. Moreover, there should be created an inexpensive, compact forging machine for carrying out this method. This object is solved by the invention in that the rotational speed of the stroke drive is adjusted to a high stroke frequency of the forging punch, and for reducing the stroke frequency the hydraulic pressure of the drive connection is decreased for periodically succeeding drive strokes in accordance with the drive-related increase with constant rotational speed of the stroke drive, while at the same time the forging punch is preferably blocked in the vicinity of the upper dead center. Due to this control step, which is as simple as elegant, the part of the mechanical drive remains independent of the reduction of the number of strokes of the forging punch, the rotational speeds of the drive, which are required for the high stroke frequencies, can be maintained, and there are no difficulties as regards the losses of kinetic energy. On the part of the hydraulic drive connection, the stroke frequency can simply be reduced in that the developing working pressure is decreased and rendered ineffective in the respectively required rhythm of the drive strokes, and the stroke frequency of the forging punch can be reduced accordingly. An idle stroke with every second drive stroke, which results from the decrease in pressure, leads to a reduction to half the stroke frequency, idle strokes with every second and third drive stroke reduce the frequency to a third or a quarter, etc.. For safety reasons and to ensure a high accuracy of the stroke, the forging punch may be blocked in the vicinity of the upper dead center together with the decrease in pressure, so that there are no wrong strokes or wrong stroke positions. In addition to the frequency control, the stroke sequence of the individual forging punches can be influenced with this method in the case of a forging machine with several forging punches, so that for instance in the case of four radially operating forging punches all four punches operate at the same time or also alternating in pairs by means of diametrically opposed idle strokes. As a result of the control of the stroke frequency all the advantages of a hydraulic drive connection remain of course unaffected, and most safety and control means of the drive connection can also be utilized in terms of control technology.

Forging machines with a hydraulic drive connection between stroke drive and forging punch are available in various constructions, where for carrying out the method the drive connection need merely be connected to an accumulator via a control valve to be actuated in dependence on the stroke movement. During a drive stroke, and when the control valve is opened, the hydraulic pressure can thus not increase to an extent required for a forging stroke, but is transferred to the accumulator and becomes effective only there, so that there is no forging stroke despite a drive stroke. In addition, the forging punch can be fixed in its upper dead center position via a suitable blocking device, which may be effected by mechanical locking devices, but hydraulic pads are expediently used for blocking a movement, which hydraulic pads provide for a higher functional safety. During the return stroke of the stroke drive, the amount of hydraulic fluid displaced from the drive connection into the accumulator is recirculated from the accumulator into the drive connection, so that blocking the control valve during the next drive stroke leads to a proper drive connection between stroke drive and punch, and when the blocked stroke of the forging punch is released, there is also effected the next forging stroke thereof.

An inexpensive construction is obtained when the drive connection comprises a pumping piston on the side of the drive and a working piston of the side of the punch, which pistons engage in a common hydraulic cylinder, where preferably the forging punch can be subjected to a pressure acting opposite to the effective direction via a hydraulic pressure spring from at least one piston drive connected to an accumulator, and the connecting line has a shut-off valve between piston drive and accumulator. Due to this direct immersion of pumping piston and working piston into a common hydraulic cylinder additional hydraulic lines are superfluous, which ensures optimum hydraulic transfer conditions. Since the forging punch is subjected to a pressure spring, the pumping piston itself need only effect the working stroke of the forging punch, the return stroke is effected by the pressure spring, and this pressure spring can also effect the blocking of the stroke of the working piston with a reduction of the stroke frequency, in that the connection between piston drives and accumulator is simply interrupted.

A further constructive improvement is achieved in that as stroke drive an eccentric drive is provided, where a sliding pad rotatably mounted on the eccentric is in positive and/or frictional engagement with the pumping piston, and the end portion of the forging punch facing away from the tool constitutes the working piston. There is obtained an extremely space-saving and compact design, which involves optimum conditions even for the hydraulic drive connection and over wide ranges provides for a stroke frequency control based on a relatively high maximum number of strokes.

It is particularly favorable when the control valve and the accumulator are mounted at the hydraulic cylinder or a housing accommodating the hydraulic cylinder, as such direct mounting renders connecting lines superfluous and compressibility influences are largely excluded.

BRIEF DESCRIPTION OF THE DRAWING

In the drawing, the subject-matter of the invention is represented in detail by way of example with reference to a schematic sectional representation of a forging machine in accordance with the invention.

DETAILED DESCRIPTION OF PREFERRED EMBODIMENT

A forging machine 1 comprises a forging punch 2, for which there are provided a mechanical stroke drive 3 and a hydraulic drive connection 4 between stroke drive 3 and forging punch 2. The hydraulic drive connection 4 consists of a hydraulic cylinder 5, in which engage on the one hand the end portion of the forging punch 2 as working piston 6 facing away from the tool, and on the other hand a pumping piston 7 designed as plunger and actuated via the stroke drive 3. The stroke drive 3 is an eccentric drive, whose eccentric 8 accommodates a rotatable sliding pad 9 for converting the rotary movement into a stroke movement as a drive movement for the pumping piston 7. The forging punch 2 guided in a longitudinal guideway 10 is subjected to a pressure opposite to the effective direction via a pressure spring 11, so that there is produced a corresponding return stroke after a working stroke, and in addition the pumping piston 7 is urged against the sliding pad 9 by means of the hydraulic fluid inside the hydraulic cylinder 5, and the drive connection does not require a positive coupling by means of a connecting link or the like. The pressure spring 11 consists of two piston drives 12, which are connected to an accumulator 14 via a connecting line 13, where the connecting line 13 comprises a shut-off valve 15, which provides for the interruption of the line connection between piston drives 12 and accumulator 14 and thus provides for blocking the stroke position of the forging punch 2.

For controlling the stroke frequency independent of the rotational speed of the eccentric of the stroke drive 3, and also for adjusting the stroke position of the forging punch 2, the cylinder space 16 of the hydraulic cylinder 5 is connected to a merely indicated system 17 for supplying hydraulic fluid, which in addition to not represented safety means, means for compensating the loss of leakage oil and temperature compensating means and the like comprises hydraulic fluid supply and discharge means 18, 19 as well as an accumulator means 20, where the system 17 for supplying hydraulic fluid is flanged directly to a common housing 21 for punch, stroke drive and drive connection, and a housing bore 22 is sufficient as connecting line. This housing bore 22 can selectively be connected with the one or other means via a multiway control valve 23.

When it is for instance desired to change the stroke position of the forging punch 2, the control valve 23 is switched such that the connecting line 22 is connected either to the hydraulic fluid supply means 18 or to the hydraulic fluid discharge means 19, and hydraulic fluid can be pumped into the cylinder space 16 or be pumped out of the same, until the forging punch 2 has been extended or retracted to the desired stroke position. In the usual forging operation, the control valve 23 is in its locking position (represented position), so that the working strokes of the stroke drive 3 are transferred with the same frequency via the drive connection 4 to the working piston and thus to the forging punch 2, and the forging punch 2 operates at a stroke frequency identical with the working frequency.

When it is desired to reduce the stroke frequency, the control valve 23 shorts out the connecting line 22 with the accumulator 20 at the required moment, so that at a working stroke of the stroke drive 3 the hydraulic fluid is delivered by the pumping piston 7 from the cylinder space 16 via the connecting line 22 into the accumulator 20 and the forging punch 2 remains idle. In this case, the shut-off valve 15 for the pressure spring 11 is also closed, and the forging punch is fixed in its position in the vicinity of the upper dead center. After one or also several idle strokes, the control valve 23 is then again switched into the locking position for the subsequent drive stroke, so that the next working stroke is again transferred to the forging punch 2, which is likewise released again by actuating the shut-off valve 15 and activating the pressure spring 11. Thus, the stroke frequency of the forging punch 2 can be varied within wide limits independent of the mechanical stroke drive 3, and when using several forging punches the stroke sequence of the individual punches can also be influenced.

We claim:

1. A forging machine comprising (a) at least one longitudinally guided forging punch carrying a forging tool at one end thereof, (b) a mechanical stroke drive for imparting a stroke movement to the forging punch, (c) a hydraulic drive connection arranged between the mechanical stroke drive and the forging punch, (d) a hydraulic pressure fluid accumulator, and (e) a control valve connecting the hydraulic drive connection with the hydraulic pressure fluid accumulator for controlling the hydraulic pressure in the hydraulic drive connection, the control valve being operable in dependence on the stroke movement.

2. The forging machine of claim 1, wherein the hydraulic drive connection comprises a cylinder, a pumping piston in the cylinder and facing the mechanical stroke drive, a working piston in the cylinder and facing the forging punch, and the pistons defining therebetween a chamber receiving the hydraulic pressure fluid.

3. The forging machine of claim 2, further comprising a hydraulic pressure spring for imparting to the forging punch a pressure opposite to the pressure imparted thereto by the hydraulic pressure connection, the hydraulic pressure spring including a hydraulic pressure fluid accumulator, a piston drive, a connecting line between the hydraulic pressure fluid accumulator of the hydraulic pressure spring and the piston drive, and a shut-off valve in the connecting line.

4. The forging machine of claim 2, wherein the mechanical stroke drive includes an eccentric drive and a sliding pad rotatably mounted thereon, the sliding pad engaging the pumping piston and an end of the forging punch opposite the one end constituting the working piston.

5. The forging machine of claim 2, wherein the hydraulic pressure fluid accumulator and the control valve are mounted on the cylinder.

6. The forging machine of claim 1, further comprising a housing encasing the mechanical stroke drive and the hydraulic drive connection, the hydraulic pressure fluid accumulator and the control valve being mounted on the housing.

* * * * *